US006602061B2

(12) United States Patent
Chuang

(10) Patent No.: US 6,602,061 B2
(45) Date of Patent: Aug. 5, 2003

(54) EASY-TO-HOLD HAND PUMP

(76) Inventor: Louis Chuang, 7th Floor - 8, No. 20, Ta Lon Road, Taichung (TW)

( * ) Notice: Subject to any disclaimer, the term of this patent is extended or adjusted under 35 U.S.C. 154(b) by 0 days.

(21) Appl. No.: 09/862,102

(22) Filed: May 21, 2001

(65) Prior Publication Data

US 2002/0018729 A1 Feb. 14, 2002

(30) Foreign Application Priority Data

Aug. 11, 2000 (TW) ..... 89214136 U

(51) Int. Cl.[7] ..... F04B 39/00; F04B 53/00; F04B 19/02

(52) U.S. Cl. ..... 417/572; 417/234; 417/468; 417/469; 92/15

(58) Field of Search ..... 417/234, 572, 417/521, 468, 469; 92/15

(56) References Cited

U.S. PATENT DOCUMENTS

D220,840 S * 6/1971 Rolsten et al. ..... D23/14
3,583,837 A * 6/1971 Rolsten ..... 137/533.11
5,690,016 A * 11/1997 Hwang ..... 417/234
5,715,554 A * 2/1998 Downs et al. ..... 152/415
6,257,849 B1 * 7/2001 Wu ..... 417/238

* cited by examiner

*Primary Examiner*—Charles G. Freay
*Assistant Examiner*—Michael K. Gray
(74) *Attorney, Agent, or Firm*—Alan D. Kamrath; Rider Bennett, LLP.

(57) ABSTRACT

A hand pump includes a head, a cylinder, a piston rod, a first handle, and a second handle. The head includes a valve-engaging portion for engaging with a valve of an article to be inflated. A first end of the cylinder is connected to the head. A piston is securely mounted to a first end of the piston rod for reciprocation in the cylinder. The first handle is securely attached to a second end of the piston rod that extends beyond a second end of the cylinder. The second handle is attached to the head to provide an auxiliary grip.

17 Claims, 13 Drawing Sheets

EASY-TO-HOLD HAND PUMP

BACKGROUND OF THE INVENTION

1. Field of the Invention

The present invention relates to an easy-to-hold hand pump that allows the user to hold the hand pump easily during use.

2. Description of the Related Art

FIG. 12 of the drawings illustrates a conventional hand pump comprising a handle 11' to which an end of a piston rod 12' is securely attached. Attached to the other end of the piston rod 12' is a piston 14' that is slidably received in a cylinder 13'. A head 15' is attached to an end of the cylinder 13' for engaging with a bicycle tire valve or the like and thus inflating the bicycle tire upon reciprocating operation of the handle 11'. It was, however, found that the user's hand tends to slip from the handle 11' during operation. FIG. 13 illustrates another conventional hand pump comprising a handle 20' having two foldable handgrips 23'. A piston rod 21' is attached to the handle 20' at an end thereof. A piston 25' is attached to the other end of the piston rod 21' and slidably received in a cylinder 24'. A head 26' is attached to an end of the cylinder 24' for engaging with a bicycle tire valve or the like. The handgrips 23' can be pivoted to an operative position indicated by 23" for inflating the bicycle tire. However, the inflating effect is poor, as the user's fingers often impinge the other end of the cylinder 24' during operation. In addition, no means is provided to secure the handgrips 23' and the cylinder 24' in place when not in use. FIG. 14 illustrates a further conventional hand pump comprising a handle 50' to which an end of a cylinder 40' is pivotally engaged at 60'. A piston rod 34' includes a first end securely engaged with a head 32' and a second end with a piston 36' that is slidably received in the cylinder 40'. The handle 50' is made of a plastic material and thus tends to disengage from the cylinder 40' when the plastic material fatigues.

SUMMARY OF THE INVENTION

It is an object of the present invention to provide an easy-to-hold hand pump that allows the user to hold the hand pump easily during use.

In accordance with a first aspect of the invention, a hand pump comprises:

- a head including a valve-engaging portion for engaging with a valve of an article to be inflated;
- a cylinder including a first end connected to the head and a second end;
- a piston rod including a first end and a second end, a piston being securely mounted to the first end of the piston rod for reciprocation in the cylinder, the second end of the piston rod extending beyond the second end of the cylinder;
- a first handle attached to the second end of the piston rod; and
- a second handle attached to the head.

In accordance with a second aspect of the invention, a hand pump comprises:

- a head including a valve-engaging portion for engaging with a valve of an article to be inflated;
- a cylinder including a first end connected to the head and a second end;
- a piston rod including a first end and a second end, a piston being securely mounted to the first end of the piston rod for reciprocation in the cylinder, the second end of the piston rod extending beyond the second end of the cylinder; and
- a handle comprising an engaging portion securely connected to the second end of the piston rod, the handle further comprising a grip portion extending from the engaging portion and being at an angle with the engaging portion, the engaging portion of the handle comprising a fingerrest extending downward from a lower side thereof.

In accordance with a third aspect of the invention, a hand pump comprises:

- a head including a valve-engaging portion for engaging with a valve of an article to be inflated;
- an outer cylinder including a first end connected to the head and a second end;
- an inner cylinder including a first end and a second end, a first piston being securely mounted to the first end of the inner cylinder for reciprocation in the outer cylinder;
- a piston rod including a first end and a second end, a second piston being securely mounted to the first end of the piston rod for reciprocation in the inner cylinder, the second end of the piston rod extending beyond the second end of the inner cylinder; and
- a handle comprising an engaging portion securely connected to the second end of the piston rod, the handle further comprising a grip portion extending from the engaging portion and being at an angle with the engaging portion, the engaging portion of the handle comprising a fingerrest extending downward from a lower side thereof.

The second handle is pivotally mounted to the head. In an embodiment of the invention, the head includes two spaced lugs having aligned pivot holes. A pin extends through the pivot holes of the lugs and an end of the second handle. One of the lugs comprises two positioning holes that correspond to an inoperative position of the second handle and an operative position of the second handle, respectively. The end of the second handle comprises a protrusion releasably engaged in one of the positioning holes.

A securing means is provided for securing the engaging portion of the handle to the second end of the outer cylinder when not in use. The securing means comprises a button pivotally mounted to the engaging portion of the handle and including an engaging member. The second end of the outer cylinder is enclosed by an engaging tube through which the piston rod extends. The engaging tube includes a positioning slot in an outer periphery thereof. The engaging member is releasably engaged in the positioning slot of the engaging tube. The engaging member of the button includes a first positioning groove and a second positioning groove that correspond to an engaging position in which the engaging member is engaged in the positioning slot of the engaging tube and a non-engaging position in which the engaging member is disengaged from the positioning slot of the engaging tube. The engaging portion of the handle comprises a protrusion that is releasably engaged in one of the first positioning groove and the second positioning groove.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
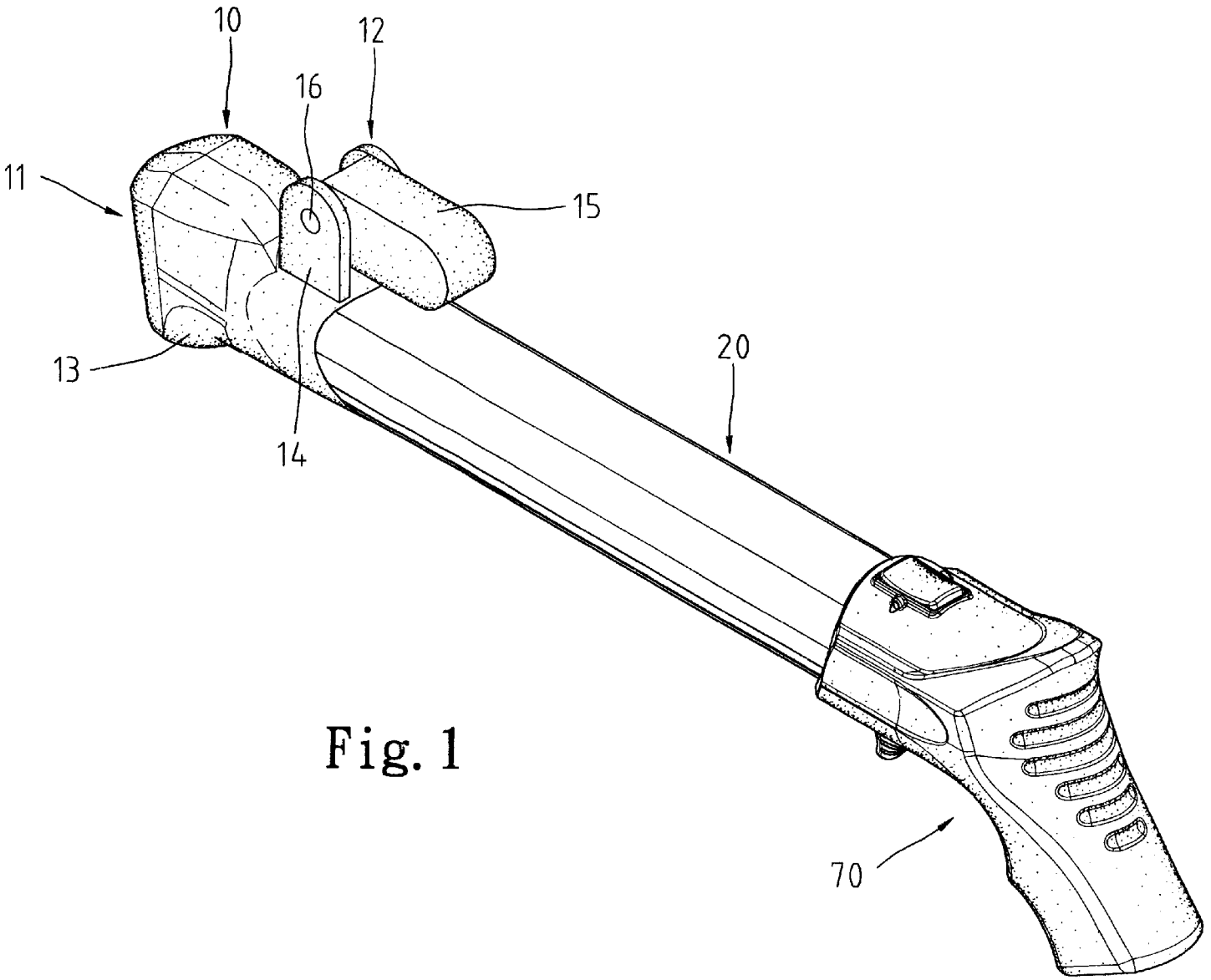
FIG. 1 is a perspective view of a first embodiment of a hand pump in accordance with the present invention.
Figure 2:
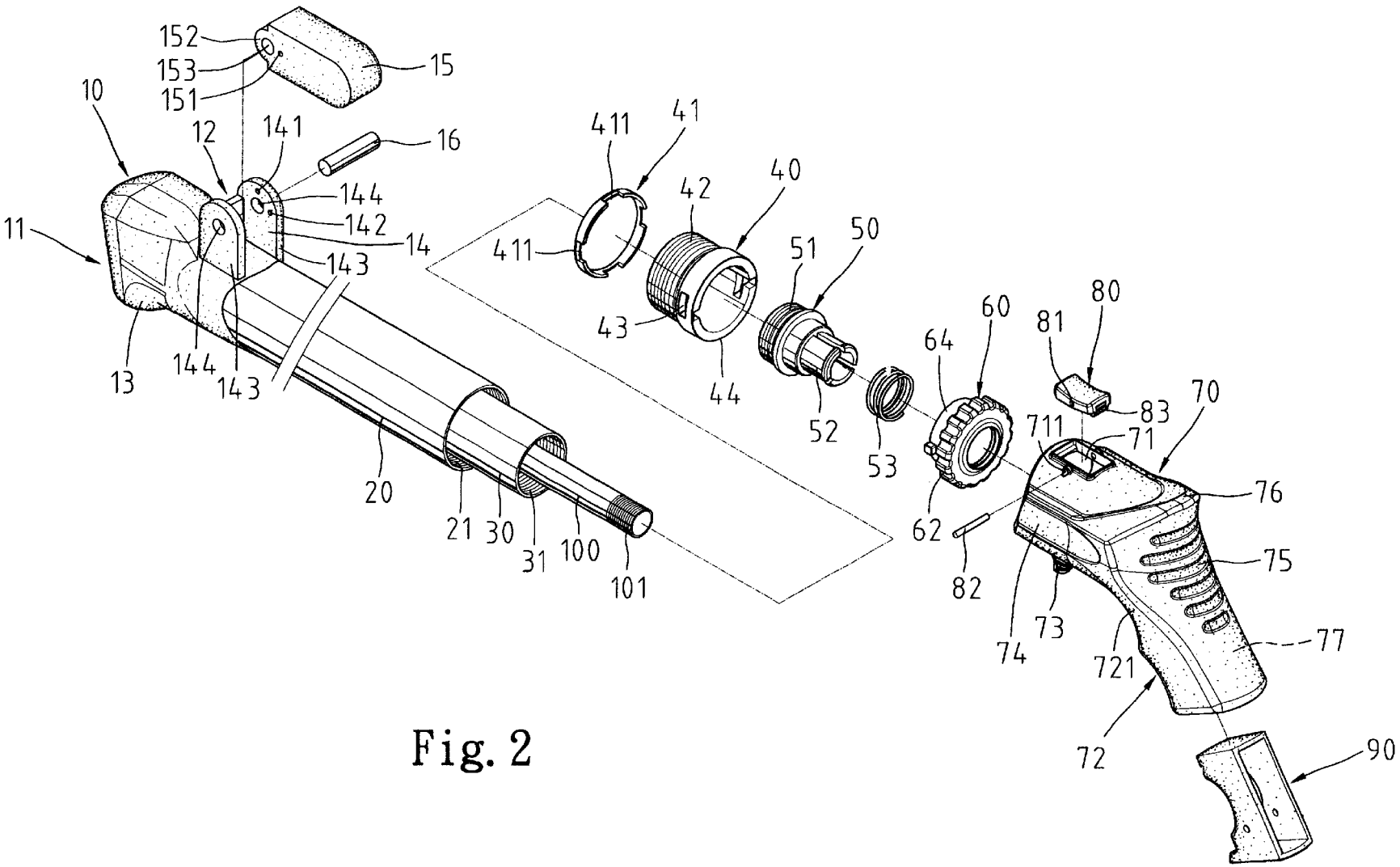
FIG. 2 is an exploded perspective view of the first embodiment of the hand pump in accordance with the present invention.
Figure 3:
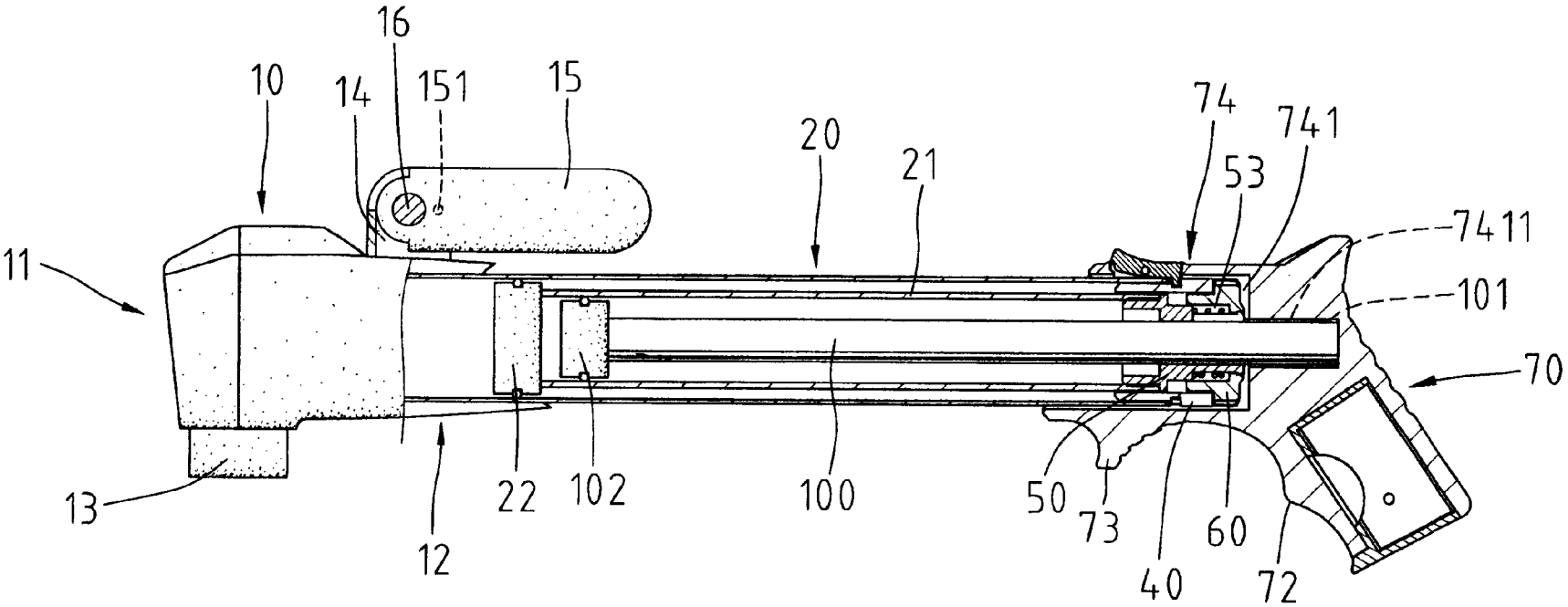
FIG. 3 is a side view, partly sectioned, of the first embodiment of the hand pump in accordance with the present invention.

Referring to FIGS. 1 through 11 and initially to FIGS. 1 through 3, a first embodiment of a hand pump in accordance with the present invention generally includes an outer cylinder 20, an inner cylinder 30, a piston rod 100, a head 10, a handle 70, and an auxiliary handle 15.

As illustrated in FIG. 3, a first piston 22 is attached to a first end of the inner cylinder 30 for reciprocation in the outer cylinder 20. A second piston 102 is attached to a first end of the piston rod 100 for reciprocation in the inner cylinder 30. A second end of the piston rod 100 is securely attached to the handle 70.

The head 10 includes a valve-engaging portion 13 at a first end 11 thereof for engaging with a valve (not shown) of a bicycle tire (not shown) or the like. The head 10 further includes a second end 12 that is securely engaged with or integrally formed with a first end of the outer cylinder 20. An auxiliary handle 15 includes an end 152 pivotally connected to the second end 12 of the head 10. In this embodiment, a pivot seat 14 in the form of two lugs 143 having aligned holes 144 is formed on the second end 12 of the head 10, and a pin 16 is extended through the holes 144 of the lugs 143 and a hole 153 in the end 152 of the auxiliary handle 15. The end 152 of the auxiliary handle 15 further includes a knurl 151 that is engaged in one of two positioning holes 141 and 142 defined in one of the lugs 143. Thus, the auxiliary handle 15 can be retained in either an inoperative position shown in FIG. 3 (for saving space when not in use) as the knurl 151 is engaged in, e.g., the positioning hole 142 or an operative position (FIG. 4) as the knurl 151 is engaged in the positioning hole 141.

The handle 70 comprises an engaging portion 74 and a grip portion 72 that is at an angle (preferably obtuse) with the engaging portion 74. Preferably, the engaging portion 74 extends along a longitudinal direction of the outer cylinder 20. The engaging portion 74 comprises a compartment 741 for receiving the second end of the piston rod 100. In this embodiment, a wall defining the compartment 741 includes a thread 7411 for engaging with an external thread 101 on the second end of the piston rod 100. The handle 70 further comprises a groove 71 (FIG. 2) in a top thereof, the groove 71 being communicated with the compartment 741. Two side walls defining the groove 71 include aligned pivot holes 711. The engaging portion 74 further includes a positioning protrusion 712 (FIG. 6) formed on a wall that defines a portion of the groove 71. A button 80 is pivotally mounted in the groove 71 and includes a lateral pivot hole 81 and an engaging member 83 on an end thereof. A pin 82 is extended through the pivot holes 711 and 81. The engaging member 83 includes a first positioning groove 831 and a second positioning groove 832, best shown in FIG. 6. The grip portion 72 includes a non-slippery face 721 for contact with fingers and an opposite non-slippery face 75 for contact with a palm. A plurality of ribs may be formed on the non-slippery face 75. The grip portion 72 of the handle 70 comprises a compartment 77 for removably receiving a box 90 that can be used to receive articles.

Figure 6:
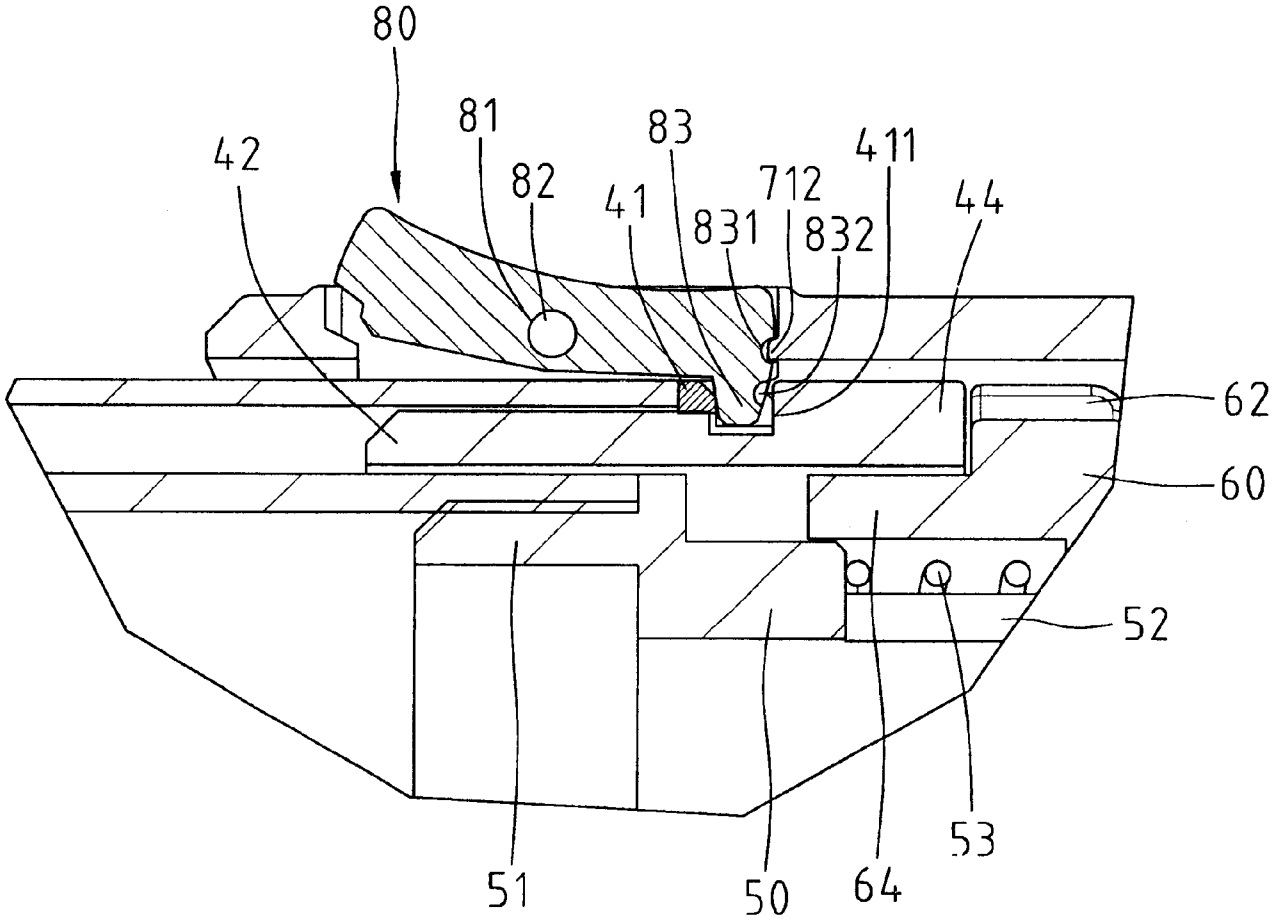
FIG. 6 is a sectional view, in an enlarged scale, of a portion of the hand pump in FIG. 5.

Referring to FIGS. 2, 3, and 6, a sleeve 60 is received in the compartment 741 of the engaging portion 74 and includes an annular flange 62 and a stem 64. The second end of the piston rod 100 extends through the sleeve 60 into the compartment 741. A coupler 50 is mounted around the piston rod 100 and includes a first tubular end 52 that is slightly received in the stem 64 of the sleeve 60 and a second tubular end 51 that is received in the inner cylinder 30. The second tubular end 51 includes an external thread for engagement with an internal thread 31 of a second end of the inner cylinder 30. A spring 53 is compressed between the first tubular end 52 of the coupler 50 and the sleeve 60. An engaging tube 40 includes a first threaded end 42 extending between the outer cylinder 20 and the inner cylinder 30 and a second end 44 surrounding the stem 64 of the sleeve 60. The first threaded end 42 of the engaging tube 40 is in engagement with an internal thread 21 at a second end of the outer cylinder 20. The second end 44 of the engaging tube 40 includes a positioning slot 43 in an outer periphery thereof. Mounted around the first threaded end 42 of the engaging tube 40 and located adjacent to the positioning slot 43 is an annular fixing ring 41 having at least one positioning notch 411.

Figure 4:
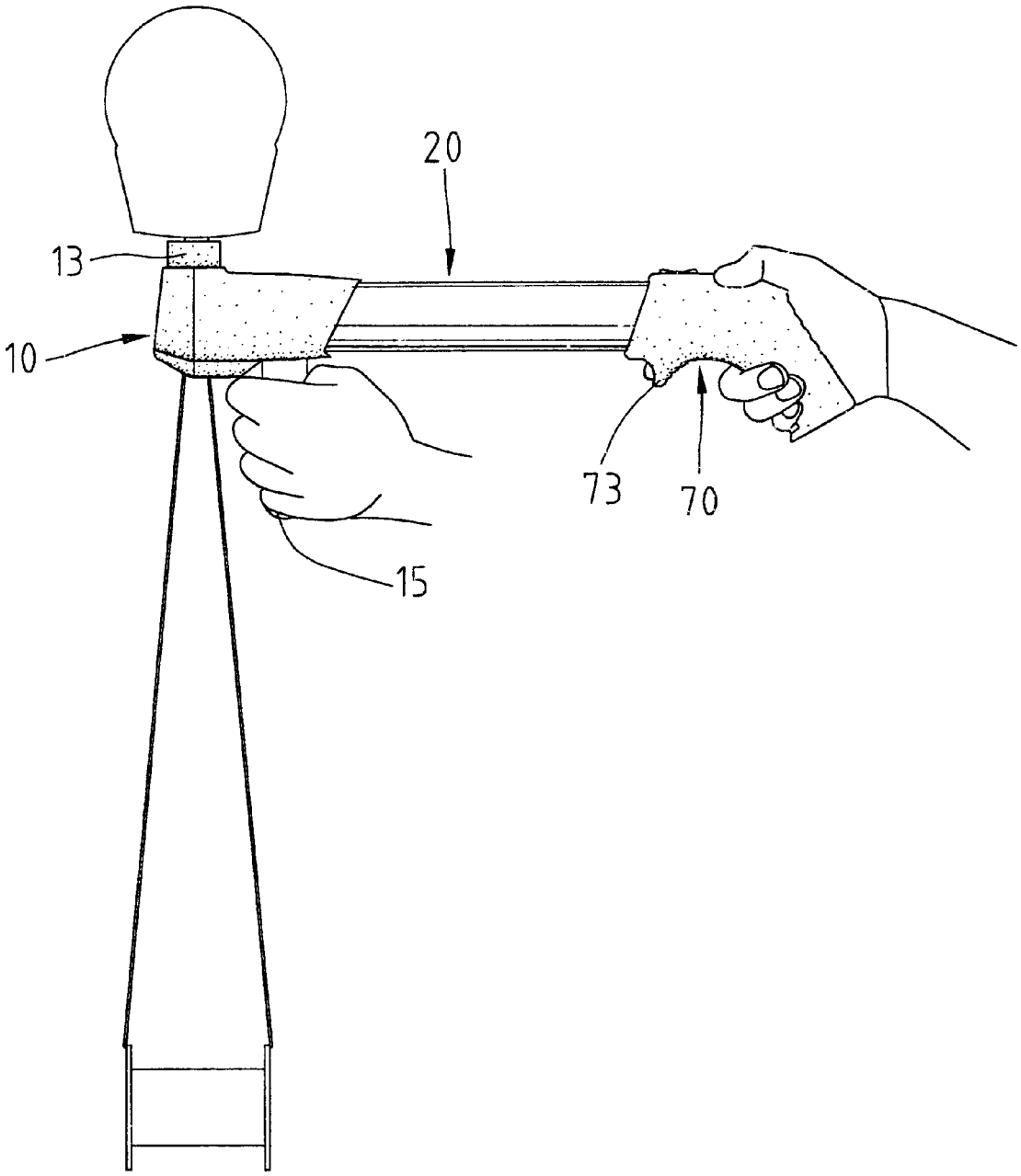
FIG. 4 is a schematic side view illustrating use of the first embodiment of the hand pump in accordance with the present invention.
Figure 5:
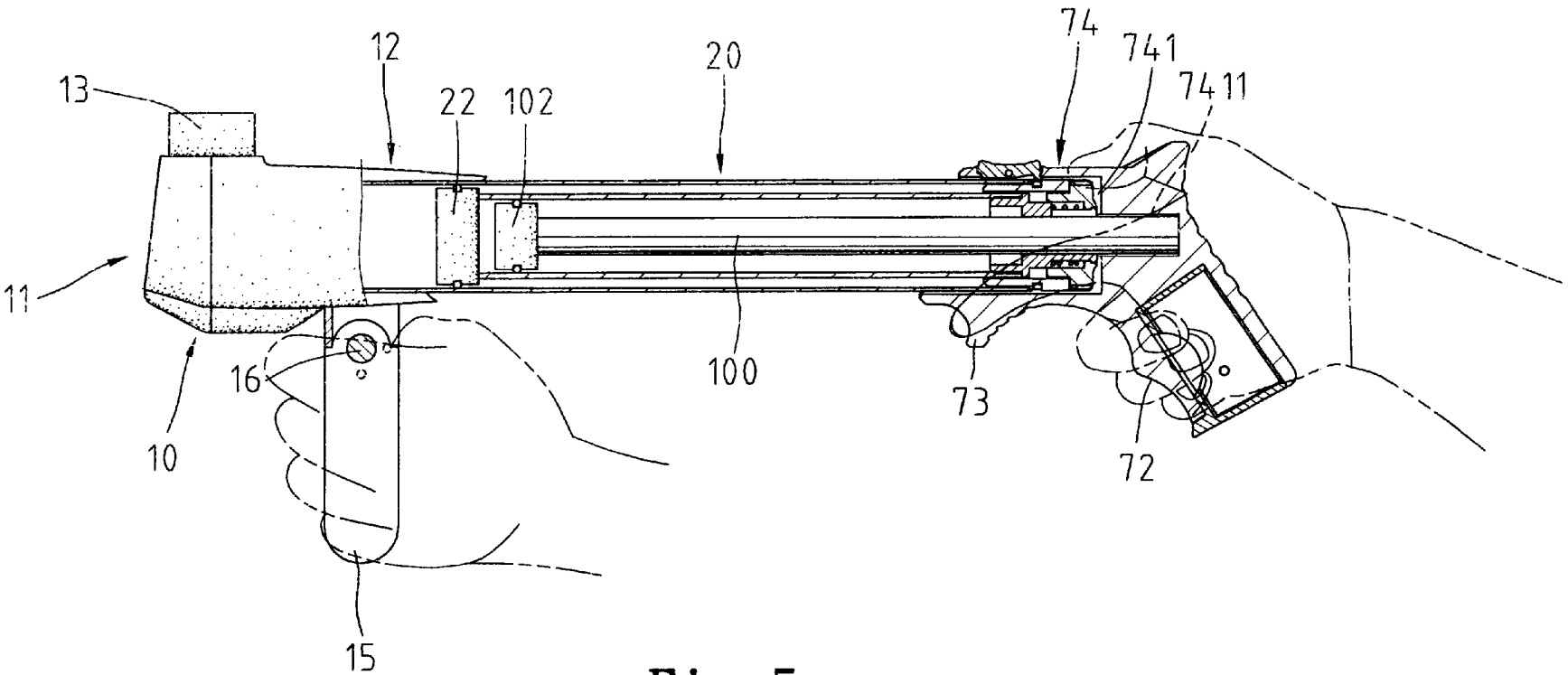
FIG. 5 is a schematic side view, partly sectioned and in an enlarged scale, of the hand pump in FIG. 4.

In use, referring to FIGS. 4 and 5, the auxiliary handle 15 is pivoted to an upright position. Thus, a right-handed user may hold the auxiliary handle 15 with his/her left hand and hold the grip portion 72 of the handle 70 with his/her right hand. The index finger of the user's right hand may rest on a fingerrest 73 projecting from a bottom of the engaging portion 74. An area between the thumb and the index finger of the user's right hand may rest on a protruded portion 76 (FIG. 2) at an upper end of the grip portion 72. Thus, the handles 70 and 15 provide a firm and reliable grip while operating the piston rod 100 for inflation. The fingers of the user will not impinge on the piston rod 100, the inner cylinder 30, and the outer cylinder 20, thereby providing an efficient inflation.

Figure 7:
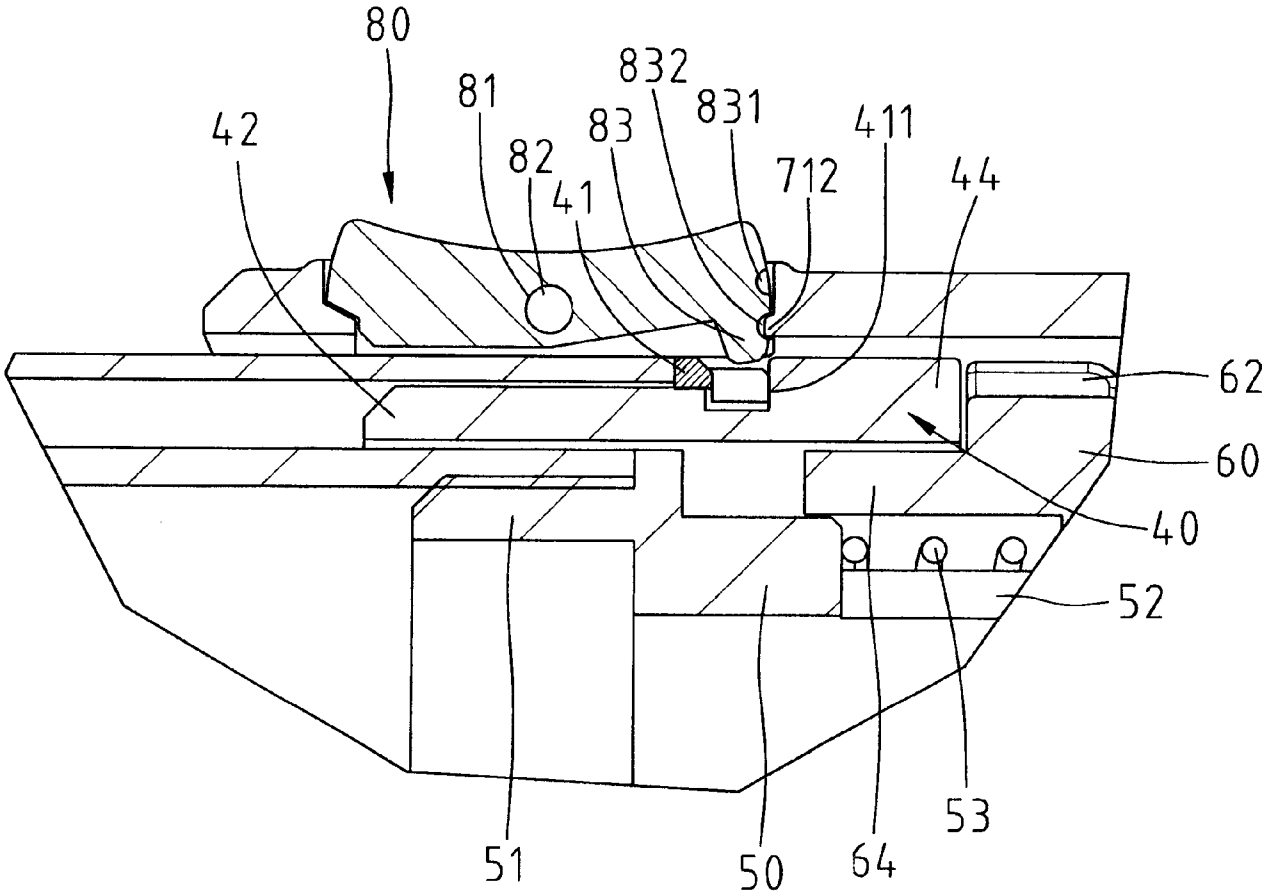
FIG. 7 is a sectional view similar to FIG. 6, illustrating operation of a button.

When not in use, as illustrated in FIG. 6, the engaging member 83 of the button 80 is extended through the positioning notch 411 of the fixing ring 41 and engaged in the positioning slot 43 of the engaging tube 40. Namely, the handle 70 and the outer cylinder 20 are engaged with each other for easy carriage. It is noted that the positioning protrusion 712 of the handle 70 is engaged in the first positioning groove 831. When inflation is required, the user pushes an end of the button 80 to move the positioning protrusion 712 to engage with the second positioning groove 832, as illustrated in FIG. 7. The engaging member 83 of the button 80 is disengaged from the positioning slot 43 of the engaging tube 40 and the positioning notch 411 of the fixing ring 41. Thus, the handle 70 is separable from the outer cylinder 20, thereby allowing reciprocation thereof for inflation, which is conventional and therefore will not be described in detail.

When not in use, as illustrated in FIG. 6, the engaging member 83 of the button 80 is extended through the positioning notch 411 of the fixing ring 41 and engaged in the positioning slot 43 of the engaging tube 40. Namely, the handle 70 and the outer cylinder 20 are engaged with each other for easy carriage. It is noted that the positioning protrusion 712 of the handle 70 is engaged in the positioning groove 831. When inflation is required, the user pushes an end of the button 80 to move the positioning protrusion 712 to engage with the other positioning groove 832, as illustrated in FIG. 7. The engaging member 83 of the button 80 is disengaged from the positioning slot 43 of the engaging tube 40 and the positioning notch 411 of the fixing ring 41. Thus, the handle 70 is separable from the outer cylinder 20, thereby allowing inflation upon reciprocating operation on the handle 70, which is conventional and therefore will not be described in detail.

Figure 8:
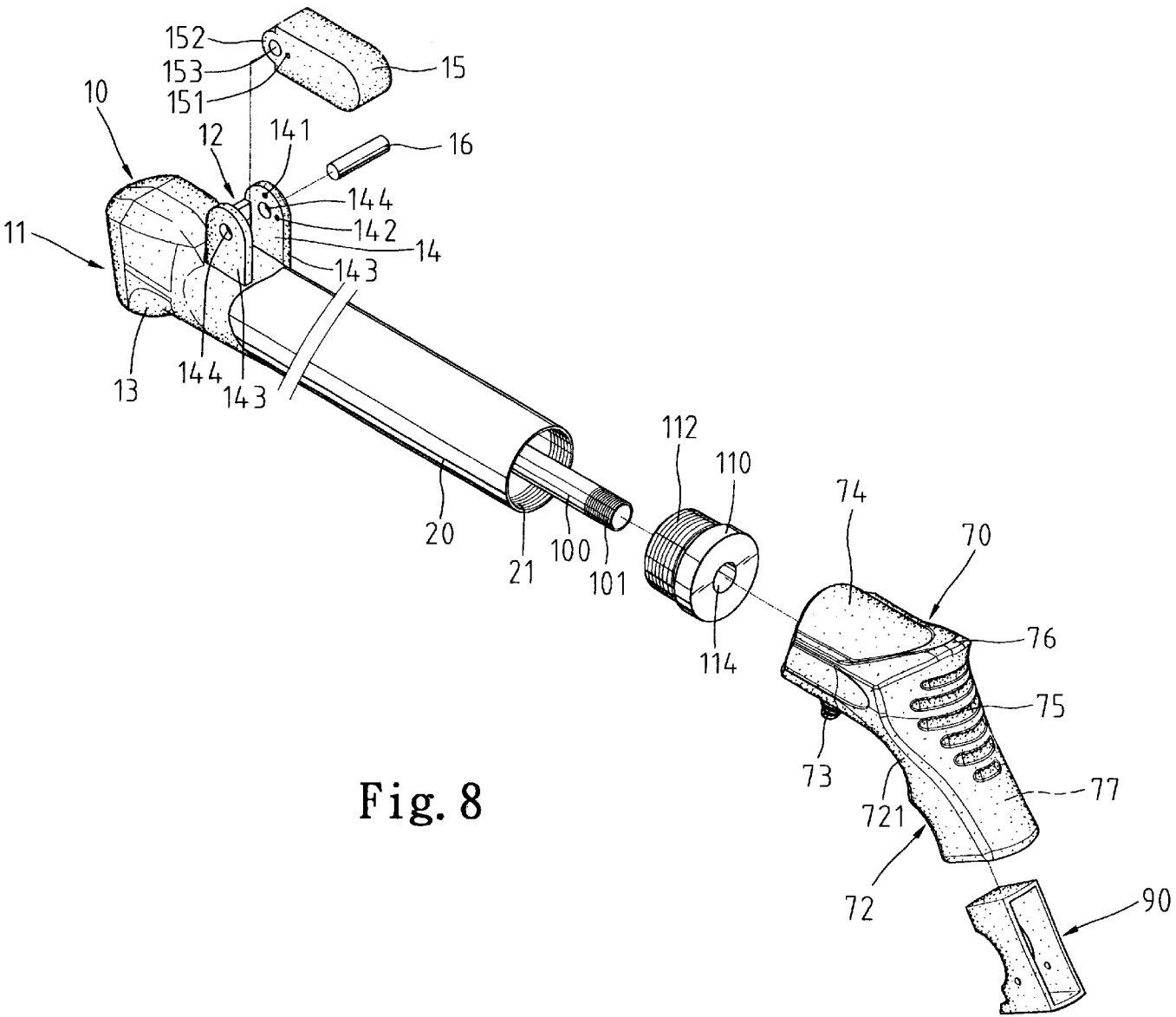
FIG. 8 is an exploded perspective view of a second embodiment of the hand pump in accordance with the present invention.
Figure 9:
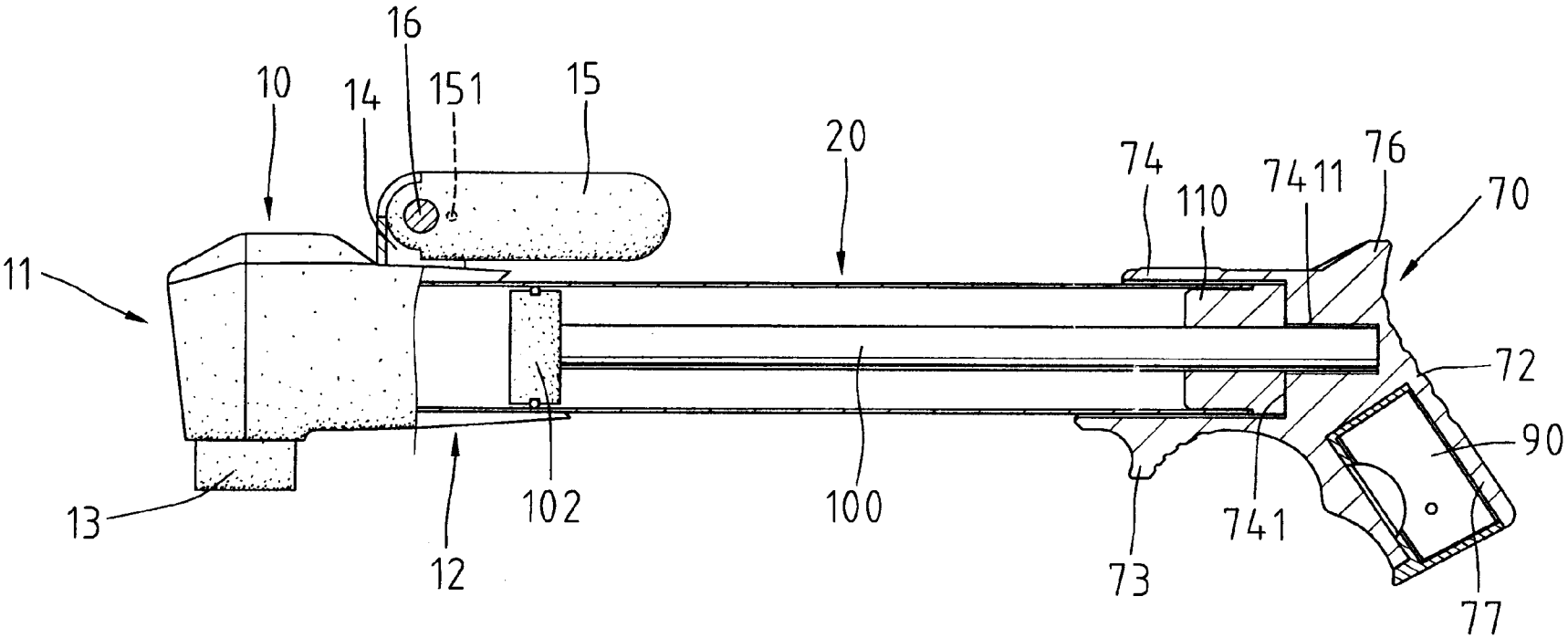
FIG. 9 is a side view, partly sectioned, of the second embodiment of the hand pump in accordance with the present invention.

Referring to FIGS. 8 and 9, a second embodiment of a hand pump in accordance with the present invention generally includes a cylinder 20, a piston rod 100, a head 10, a handle 70, and an auxiliary handle 15.

As illustrated in FIG. 9, a piston 102 is attached to a first end of the piston rod 100 for reciprocation in the cylinder 20. A second end of the piston rod 100 is securely attached to the handle 70 to move therewith.

The head 10 includes a valve-engaging portion 13 at a first end 11 thereof for engaging with a valve (not shown) of a bicycle tire (not shown) or the like. The head 10 further includes a second end 12 that is securely engaged with or integrally formed with a first end of the cylinder 20. An auxiliary handle 15 includes an end 152 pivotally connected by a pin 16 to a pivot seat 14 formed on the second end 12 of the head 10. Structure and operation of the auxiliary handle 15 and the pivot seat 14 are identical to those of the first embodiment.

The handle 70 comprises an engaging portion 74 and a grip portion 72 that extends from the engaging portion 74 at an angle (preferably obtuse). Preferably, the engaging portion 74 extends along a longitudinal direction of the cylinder 20. The engaging portion 74 comprises a compartment 741 for receiving the second end of the piston rod 100. In this embodiment, a wall defining the compartment 741 includes a thread 7411 for engaging with an external thread 101 on the second end of the piston rod 100, as best shown in FIG. 9. In addition, an end cap 110 is mounted to the other end of the cylinder 20. The end cap 110 includes an external thread 112 for engagement with an internal thread 21 of the cylinder 20. The end cap 110 further includes a longitudinal hole 114 through which the piston rod 100 extends. The grip portion 72 of the handle 70 comprises a compartment 77 for removably receiving a box 90 that can be used to receive articles.

Figure 10:
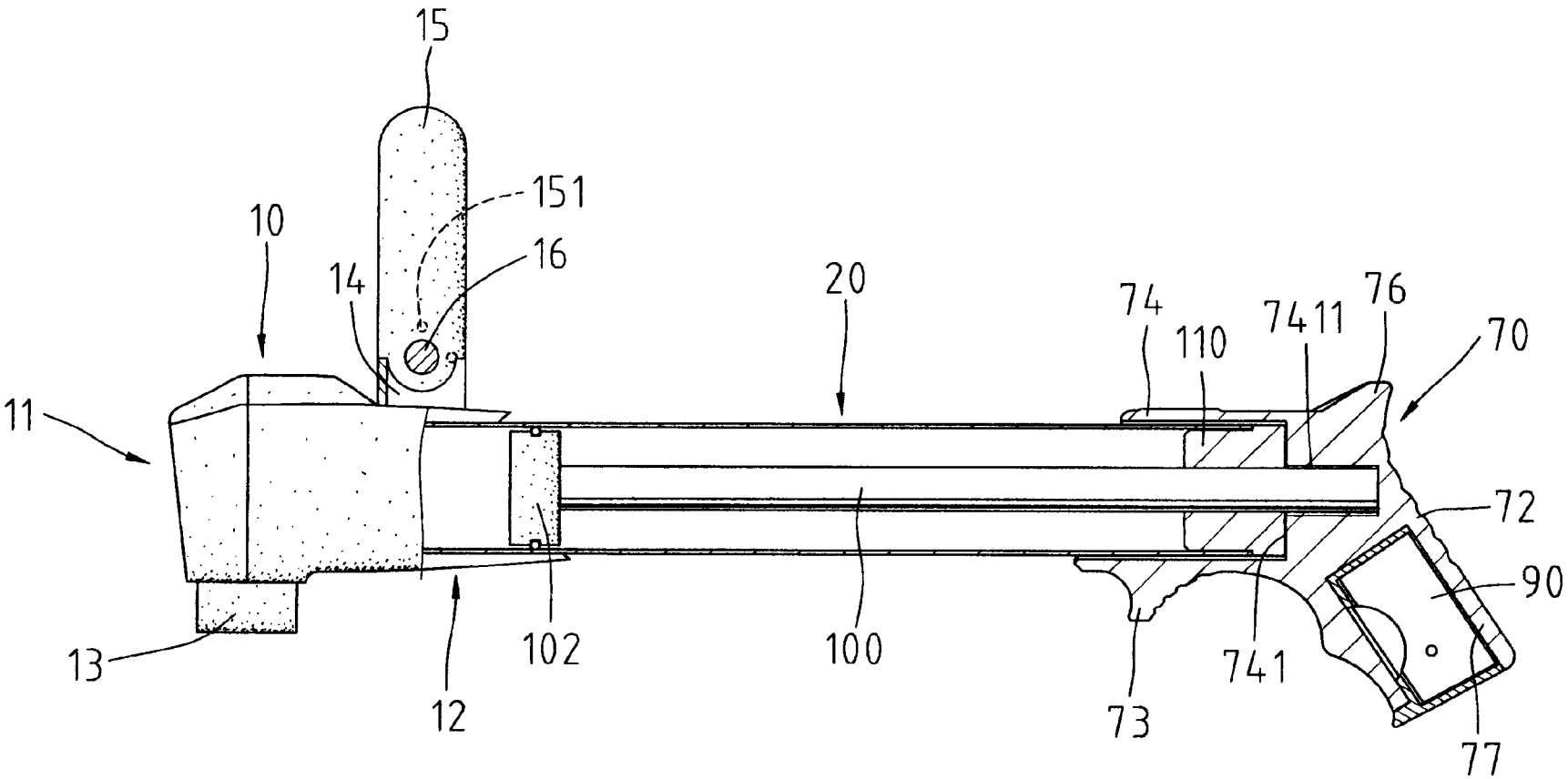
FIG. 10 is a side view similar to FIG. 9, wherein an auxiliary handle of the hand pump is pivoted to an operative position.
Figure 11:
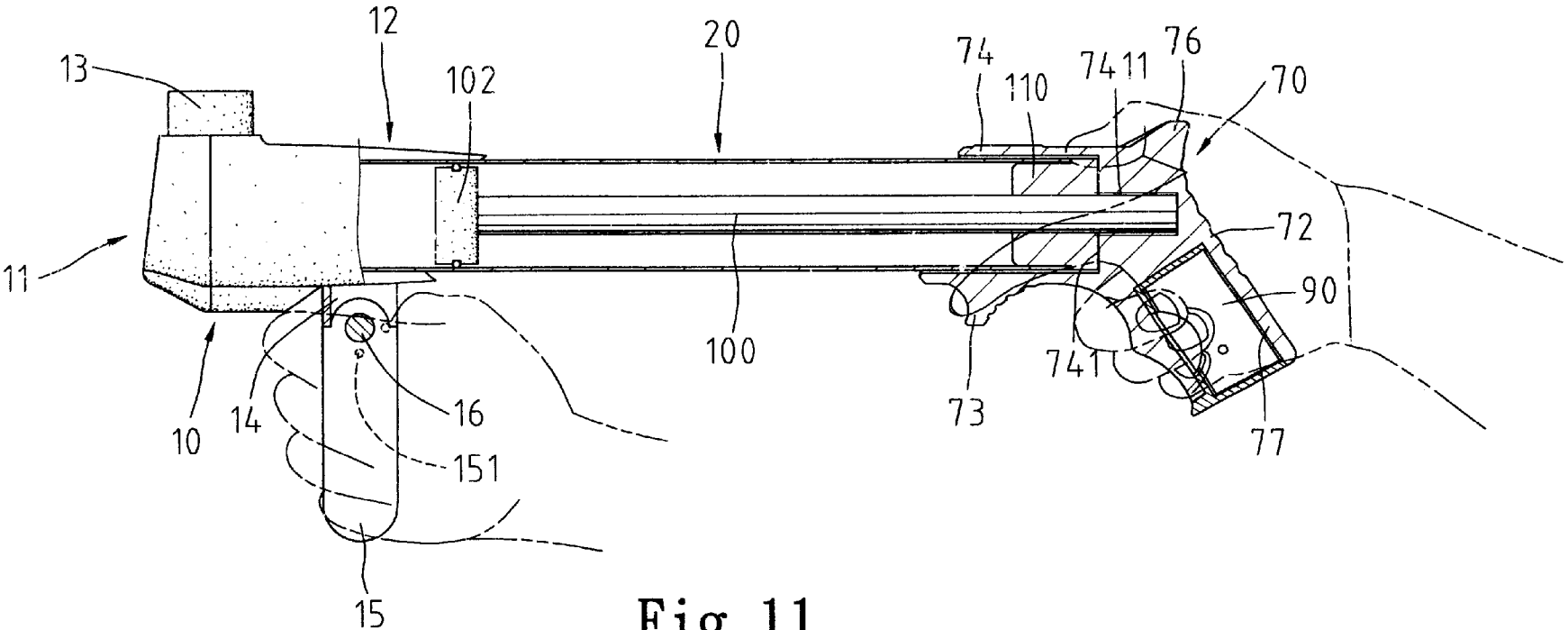
FIG. 11 is a side view similar to FIG. 10, illustrating operation of the hand pump in FIG. 10.
Figure 12:
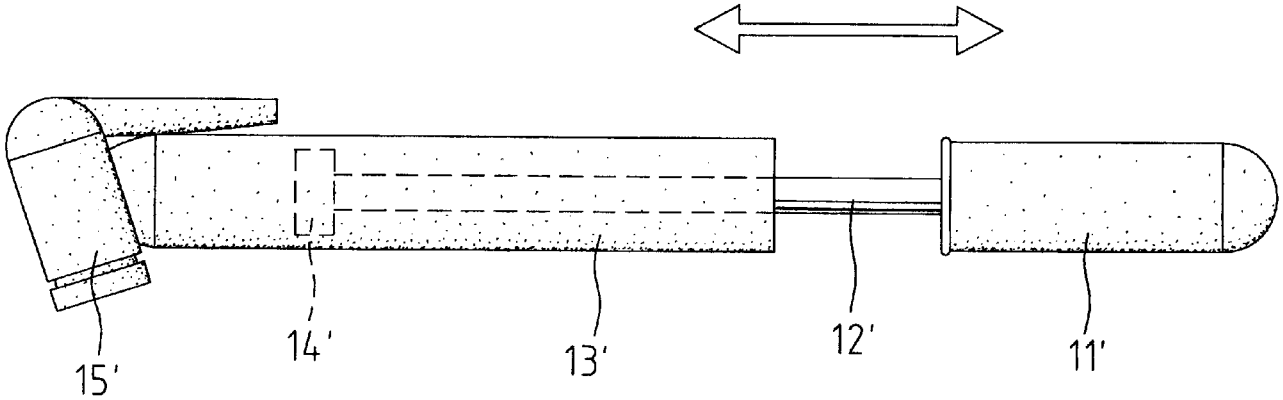
Fig. 12 PRIOR ART
FIG. 12 is a schematic side view of a conventional hand pump.
Figure 13:
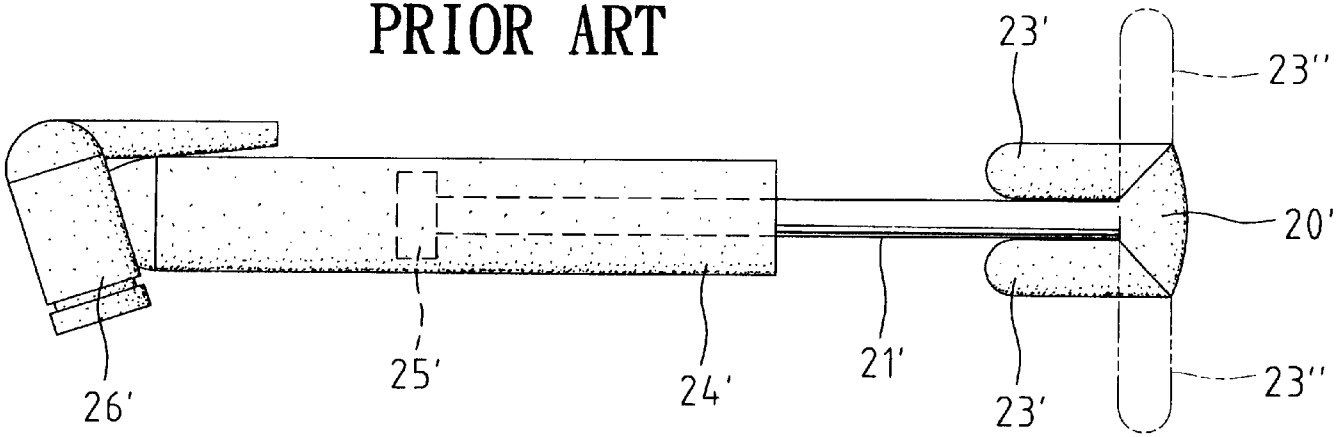
Fig. 13 PRIOR ART
FIG. 13 is a schematic side view of another conventional hand pump.
Figure 14:
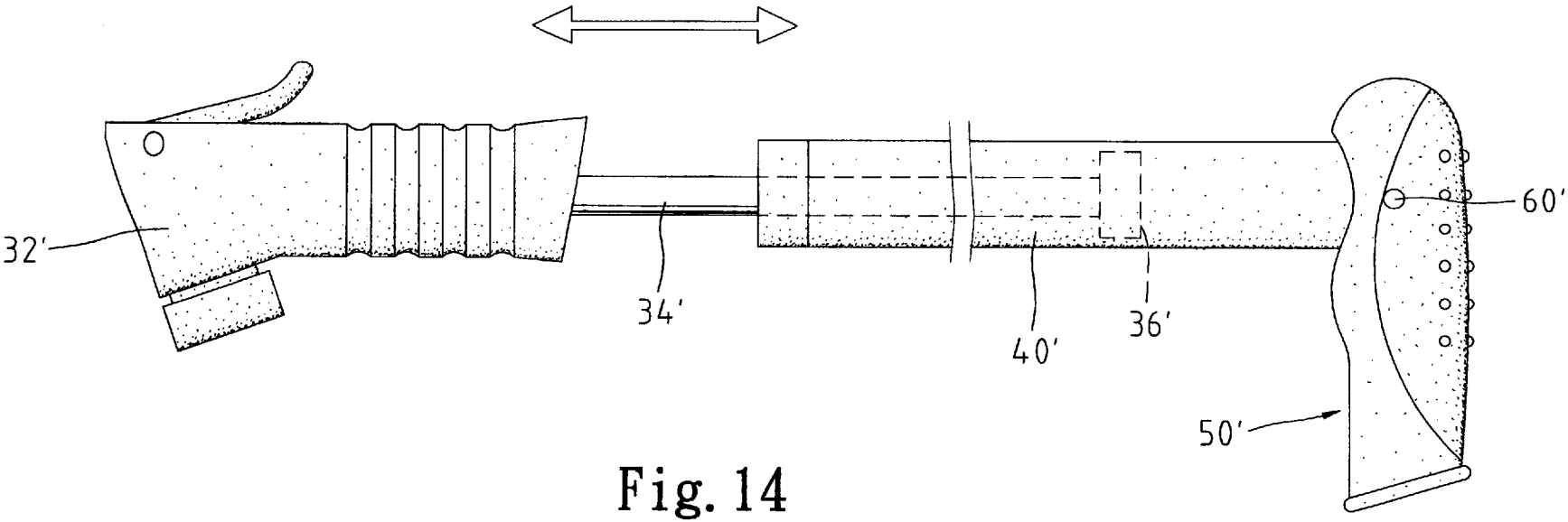
Fig. 14 PRIOR ART
FIG. 14 is a schematic side view of a further conventional hand pump.

In use, referring to FIGS. 10 and 11, the auxiliary handle 15 is pivoted to an upright position. Thus, a right-handed user may hold the auxiliary handle 15 with his/her left hand and hold the grip portion 72 of the handle 70 with his/her right hand. The index finger of the user's right hand may rest on a fingerrest 73 projecting from a bottom of the engaging portion 74. An area between the thumb and the index finger of the user's right hand may rest on a protruded portion 76 at an upper end of the grip portion 72. Thus, the handles 70 and 15 provide a firm and reliable grip during reciprocation of the piston rod 100 for inflation. More particularly, the handle 70 provides a pistol grip for firm and reliable grip. The fingers of the user will not impinge on the piston rod 100 and the cylinder 20, thereby providing an efficient inflation.

Although the invention has been explained in relation to its preferred embodiment, it is to be understood that many other possible modifications and variations can be made without departing from the scope of the invention as hereinafter claimed.

What is claimed is:

1. A hand pump comprising:

a head including a valve-engaging portion for engaging with a valve of an article to be inflated, with the head further including two positioning holes;

a cylinder including a first end connected to the head and a second end;

a piston rod including a first end and a second end extending beyond the second end of the cylinder;

a piston secured to the first end of the piston rod for reciprocation in the cylinder;

a first handle attached to the second end of the piston rod; and a second handle pivotally mounted to the head and including a protrusion formed thereon for releasable engagement in one of the positioning holes in an inoperative position thereof and for releasable engagement in the remaining one of the positioning holes in an operative position thereof.

2. The hand pump as claimed in claim 1, wherein the first handle comprises an engaging portion securely connected to the second end of the piston rod, the first handle further comprising a grip portion extending from the engaging portion and being at an angle with the engaging portion.

3. The hand pump as claimed in claim 2, wherein the engaging portion of the first handle comprises a trigger-shaped fingerrest extending downward from a lower side thereof.

4. The hand pump as claimed in claim 2, wherein a rear end of the engaging portion and an upper end the grip portion have a protruded portion therebetween and upon which an area between a user's thumb and index finger rests when the grip portion is grasped in a user's hand.

5. The hand pump as claimed in claim 1, wherein the head comprises two spaced lugs having aligned pivot holes, the second handle comprising an end, with the hand pump further comprising a pin extending through the pivot holes of the lugs and the end of the second handle.

6. The hand pump as claimed in claim 5, wherein one of the lugs includes the two positioning holes and the end of the second handle includes the protrusion.

7. A hand pump comprising:

a head including a valve-engaging portion for engaging with a valve of an article to be inflated;

a cylinder including a first end connected to the head and a second end;

a piston rod including a first end and a second end extending beyond the second end of the cylinder;

a piston secured to the first end of the piston rod for reciprocation in the cylinder; and a handle comprising an engaging portion securely connected to the second end of the piston rod, a grip portion extending from the engaging portion at an angle, and a trigger-shaped fingerrest extending downward from a lower side of the engaging portion.

8. The hand pump as claimed in claim 7, wherein a rear end of the engaging portion and an upper end the grip portion have a protruded portion therebetween and upon which an area between a user's thumb and index finger rests when the grip portion is grasped in a user's hand.

9. A hand pump comprising:

a head including a valve-engaging portion for engaging with a valve of an article to be inflated;

an outer cylinder including a first end connected to the head and a second end;

an inner cylinder including a first end and a second end;

a first piston secured to the first end of the inner cylinder for reciprocation in the outer cylinder;

a piston rod including a first end and a second end extending beyond the second end of the cylinder;

a second piston secured to the first end of the piston rod for reciprocation in the inner cylinder; and a handle comprising an engaging portion securely connected to the second end of the piston rod, the handle further comprising a grip portion extending from the engaging portion and being at an angle with the engaging portion, the engaging portion of the handle comprising a fingerrest extending downward from a lower side thereof.

10. The hand pump as claimed in claim 9, wherein a rear end of the engaging portion and an upper end the grip portion have a protruded portion therebetween and upon which an area between a user's thumb and index finger rests when the grip portion is grasped in a user's hand.

11. The hand pump as claimed in claim 9, further comprising a second handle attached to the head.

12. The hand pump as claimed in claim 11, wherein the second handle is pivotally mounted to the head.

13. The hand pump as claimed in claim 12, wherein the head comprises two spaced lugs having aligned pivot holes, the second handle comprising an end, further comprising a pin extending through the pivot holes of the lugs and the end of the second handle.

14. The hand pump as claimed in claim 13, wherein one of the lugs comprises two positioning holes that correspond to an inoperative position of the second handle and an operative position of the second handle, respectively, the end of the second handle comprising a protrusion releasably engaged in one of the positioning holes.

15. The hand pump as claimed in claim 9, further comprising means for securing the engaging portion of the handle and the second end of the outer cylinder together when not in use.

16. The hand pump as claimed in claim 15, wherein said securing means comprises a button pivotally mounted to the engaging portion of the handle and including an engaging member, the second end of the outer cylinder being enclosed by an engaging tube, the piston rod being extended through the engaging tube, the engaging tube including a positioning slot in an outer periphery thereof, the engaging member being releasably engaged in the positioning slot of the engaging tube.

17. The hand pump as claimed in claim 16, wherein the engaging member of the button includes a first positioning groove and a second positioning groove that correspond to an engaging position in which the engaging member is engaged in the positioning slot of the engaging tube and a non-engaging position in which the engaging member is disengaged from the positioning slot of the engaging tube, the engaging portion of the handle comprising a protrusion that is releasably engaged in one of the first positioning groove and the second positioning groove.

* * * * *